US006868904B1

(12) United States Patent
Kwader

(10) Patent No.: US 6,868,904 B1
(45) Date of Patent: Mar. 22, 2005

(54) WELL DEVELOPMENT TOOL AND METHOD FOR USE THEREOF

(76) Inventor: Thomas Kwader, 2620 Lucerne Dr., Tallahassee, FL (US) 32303

( * ) Notice: Subject to any disclaimer, the term of this patent is extended or adjusted under 35 U.S.C. 154(b) by 0 days.

(21) Appl. No.: 10/198,416

(22) Filed: Jul. 18, 2002

(51) Int. Cl.[7] ..... E21B 43/00
(52) U.S. Cl. ..... 166/106
(58) Field of Search ..... 166/105, 105.2, 166/106, 67, 68, 311

(56) References Cited

U.S. PATENT DOCUMENTS

| | | | | | |
|---|---|---|---|---|---|
| 44,878 | A | * | 11/1864 | Mowbrey | 417/172 |
| 46,124 | A | * | 1/1865 | Lyon | 166/189 |
| 278,751 | A | * | 6/1883 | Shaw | 166/105 |
| 615,760 | A | * | 12/1898 | Smith | 166/52 |
| 818,522 | A | * | 4/1906 | Cox | 417/547 |
| 1,431,778 | A | * | 10/1922 | Conrader | 166/265 |
| 1,519,585 | A | * | 12/1924 | Langstaff | 166/105 |
| 1,568,857 | A | * | 1/1926 | McGee | 417/431 |
| 1,583,756 | A | * | 5/1926 | Shea | 166/106 |
| 1,844,979 | A | * | 2/1932 | Rohe et al. | 166/106 |
| 4,751,969 | A | * | 6/1988 | Klaeger | 166/369 |
| 5,054,557 | A | * | 10/1991 | Wittrisch | 166/309 |
| 5,259,450 | A | * | 11/1993 | Fischer | 166/68 |
| 5,450,897 | A | * | 9/1995 | Brown | 166/68 |

* cited by examiner

*Primary Examiner*—David Bagnell
*Assistant Examiner*—Daniel P Stephenson
(74) *Attorney, Agent, or Firm*—Peter Loffler

(57) ABSTRACT

A well development tool quickly develops a well created for underground water testing using a hollow tubular member that has a check valve on an end and a washer that has a diameter that is at least equal to the inside diameter of a well casing within the well. The well development tool is reciprocated up and down so that the washer pushes and pulls on the underground water and the tool captures the water that is originally at the well casing site and allows outlying water to percolate to the well casing.

29 Claims, 2 Drawing Sheets

WELL DEVELOPMENT TOOL AND METHOD FOR USE THEREOF

BACKGROUND OF THE INVENTION

1. Field of the Invention

The present invention relates to a well development tool and method that is used to remove ground water that is artificially contaminated or disturbed by the installation of the well and to help impacted ground water to be removed from the formation in the vicinity of the well.

2. Background of the Prior Art

Many industries, such as dry cleaners and gas stations, use various chemicals, such as heavy metals and chlorinated solvents, that if leeched into the ground, cause ground water contamination. Accordingly, the groundwater around potentially polluting sites is regularly monitored to assure that groundwater contamination does not occur or its movement is known. If contamination does occur, corrective action can be taken immediately to minimize environmental impacts.

A typical groundwater monitoring program involves the boring of several holes into the ground, to the level of the aquifer which can be up to 40 feet or more underground. After the boring of each hole, a well casing is dropped into the hole and a water sample is taken from the well casing. Typically, the well casing is made from PVC and is 1 to 2 inches or more in diameter. The lower end of the well casing—the end that is furthest in the ground—has a well casing screen which consists of a slotted PVC screen with narrow openings cut into the well casing. The boring of the ground and the sinking of the well casing into the ground causes disturbance within the soil, which if sampled immediately after the boring and sinking of the well casing, gives a false reading which is not truly reflective of the true groundwater conditions. The removal of the fine sediments is required before a sampling can be taken in order to get an accurate sample of the formation water.

Certain tools have been developed in order to "develop" the bored well in order to expedite the removal of the turbid water at the well casing in order to return the groundwater to equilibrium. Such tools remove the water that is in the immediate vicinity of the well casing which allows undisturbed water to percolate to the well casing area and replace the removed water. Such prior art devices include pumps and bailers that can advance the time when an accurate sample can be taken, although such devices are not without drawbacks.

Many such prior art devices are very expensive, with many bailers costing several hundred dollars. Additionally, such devices are bulky and are relatively difficult to use. Furthermore, if these devices are not used correctly, such as not being thoroughly cleaned between use in well casings, they can contaminate the water within the well casing in subsequently sampled wells. Even if correctly cleaned between use in well casings, such cleaning is labor intensive and time consuming. Additionally, current prior art devices only have the ability to pull water from within the casing upwards out of the casing.

Therefore, there exists a need in the art for a well development tool that helps expedite the clearing of the water at the base of a well casing so that a representative water sample can be taken, which well development tool addresses the above-stated concerns in the art. Specifically, the well development tool must be of relatively simple design and construction making it relatively inexpensive to manufacture, so that, advantageously, the well development tool can be discarded after developing a single well in order to eliminate problems with cross well contamination. The well development tool must be able to force groundwater downwardly in the casing in order to force water out of the screen, thereby effectively agitating the disturbed area and accelerating the removal of clay and silt sized particles contributing to the turbidity. The well development tool must be relatively compact in size and must be easy to use.

SUMMARY OF THE INVENTION

The well development tool and method for use thereof of the present invention addresses the aforementioned needs in the art. The well development tool helps expedite the clearing of the disturbed water at the base of a well casing in order for undisturbed water to percolate to the well casing so that an accurate (turbid free) water sample can be taken. The well development tool is of relatively simple design and construction making the tool relatively inexpensive to manufacture, so that the well development tool can be discarded after developing a single well, thereby eliminating the problem of cross well contamination which can occur through repeated uses of similar items. The well development tool is able to force groundwater downwardly in the casing in order to force water out of the screen, thereby effectively agitating the disturbed area and accelerating the removal of clay and silt sized particles contributing to the turbidity. The well development tool is compact in size and is easy to use.

The well development tool and method for use thereof of the present invention is comprised of a hollow first tubular member that has an outer surface, a first end, and a second end. A check valve is disposed within the first tubular member at the first end. A flexible washer encompasses the outer surface of the first tubular member proximate the first end. The first tubular member is made from PVC. The washer is made from a resilient material such as rubber or neoprene. A semi-rigid handle is attached to the first tubular member and comprises an elbow attached to the second end of the first tubular member and a second tubular attached to the elbow. The handle has an upper valve to stop the flow of water upwardly when agitation of the formation is desired. The first tubular member is inserted into a well casing which extends into the ground with the first tubular member being reciprocated up and down within the well casing. The inside of the well casing has a first diameter and the washer has a second diameter that is at least equal to the first diameter.

BRIEF DESCRIPTION OF THE DRAWINGS

Similar reference numerals refer to similar parts throughout the several views of the drawings.

DESCRIPTION OF THE PREFERRED EMBODIMENT

Figure 1:
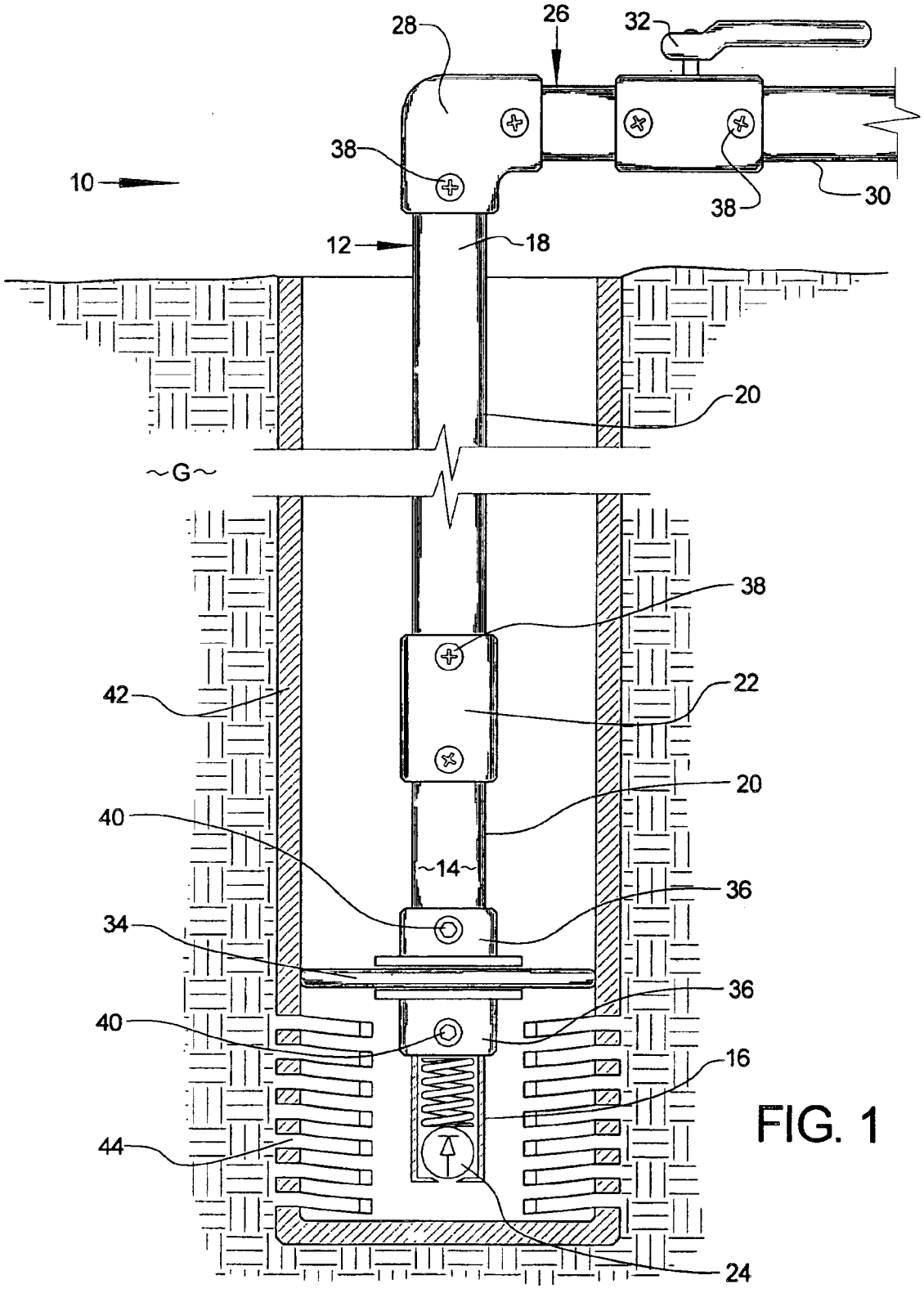
FIG. 1 is an environmental view of the well development tool of the present invention disposed within a well casing.
Figure 2:
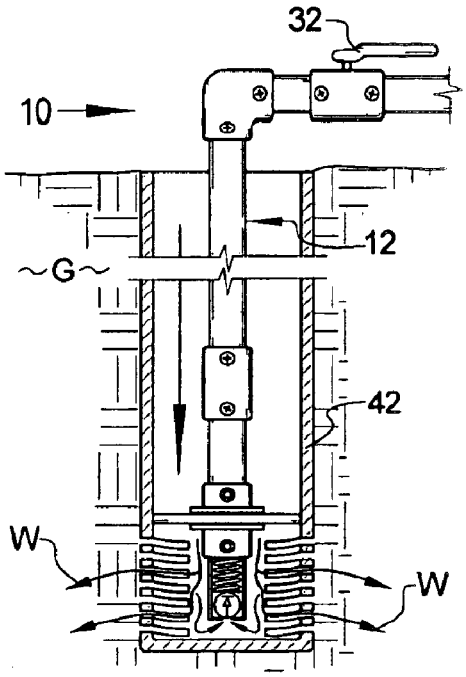
FIG. 2 illustrates the well development tool disposed within the well casing at the lower point of travel for the tool with the upper valve open.
Figure 3:
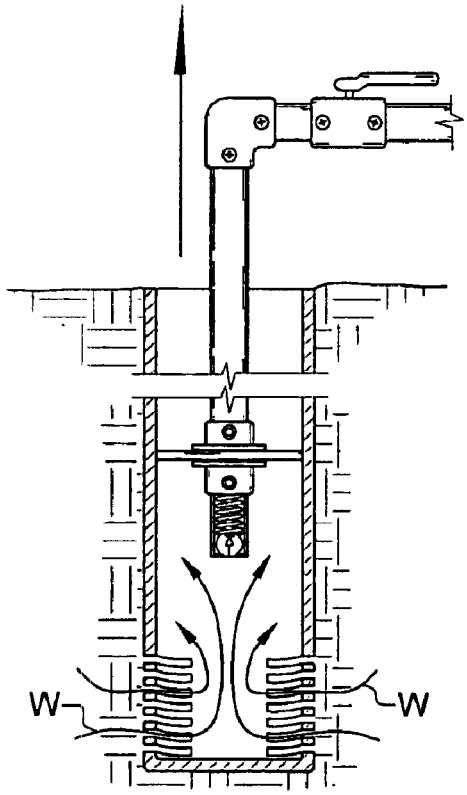
FIG. 3 illustrates the well development tool disposed within the well casing at the upper point of travel for the tool.
Figure 4:
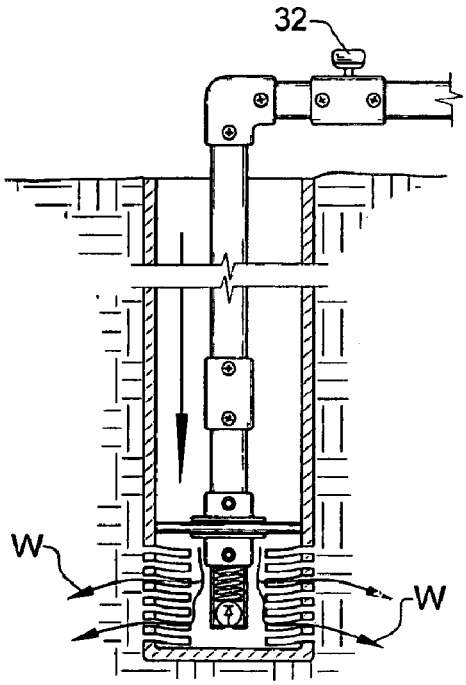
FIG. 4 illustrates the well development tool disposed within the well casing at the lower point of travel for the tool with the upper valve closed.

Referring now to the drawings, it is seen that the well development tool and method for use thereof of the present invention, generally denoted by reference numeral 10, is comprised of a hollow first tubular member 12 that has an outer surface 14, a first end 16, and a second end 18. The first tubular member 12 may be made as a single continuous member of monolithic construction, or for ease of transport, the tubular member 12 may be made of two or more sections 20 that are connected by an appropriate connector 22. A check valve 24 of any appropriate design known in the art, is disposed within the first tubular member 12 at the first end 16. A handle 26 is attached to the first tubular member 12 and comprises an elbow 28 attached to the second end 18 of the first tubular member 12 and a hollow second tubular 30 attached to the elbow 28. The handle 26 has an upper valve 32. A flexible washer 34 encompasses the outer surface 14 of the first tubular member 12 proximate the first end 16 just above the check valve 24. The washer 34 may be held in place by sandwiching the washer 34 between two stiff position washers 36.

The well development tool 10 is made from materials that are inert in ground water W so that they do not introduce any contaminants for which the ground water W will be tested. Accordingly, the first tubular member 12, the second tubular member 30, the elbow 28 and any connectors 22 are made from PVC or other similar material. As adhesives can contaminate the water W to be tested, the connector 22 that attaches two sections 20 together, either on the first tubular member 12, the second tubular member 30 or both, as well as the elbow 28 that connects the two tubular members 12 and 30 together are each attached to their respective members by stainless steel screws 38 which will not contaminate the water W to be tested. The washer 34 is made from a resilient material such as rubber and neoprene, neither of which will impact the quality of the water W to be tested. The position washers 36 are made from stainless steel and are held in place against the outer surface 14 of the first tubular member 12 by the use of stainless steel set screws 40.

At the area where ground water W is to be tested, a hole is bore into the ground G at least to the level of the ground water W and a well casing 42 having a well casing screen 44 at its distal end is inserted into the hole. The first end 16 of the first tubular member 12 is inserted into the well casing 42 until the first end 16 is located proximate the well casing screen 44. The inside of the well casing 42 has a first diameter and the washer 34 has a second diameter that is at least equal to the first diameter. The well development tool 10 is dimensioned so that when the first end 16 of the first tubular 12 is located proximate the well casing screen 44, the handle 26 (if used) is located a sufficient distance above the ground G so that a person can manually grasp the well development tool 10 and reciprocate it up and down within the well casing 42, taking approximately 1–2 foot strokes, (it being understood that an appropriate reciprocation machine can be used for up and down reciprocation of the well development tool 10). The up and down reciprocation of the well development tool 10 causes the washer 34 to go up and down within a portion of the well casing 42. As the diameter of the washer 34 is at least equal to the inside diameter of the well casing 42 (as the washer 34 is made from a resilient material, the washer 34 can have a diameter that is slightly greater than the diameter of the inside of the well casing 42 without inhibiting up and down travel of the washer 34 within the well casing 42), during the downward stroke of the well development tool 10 with the upper valve 32 closed, the washer 34 pushes on the underground water W causing it to be pushed out of and away from the well casing 42. Additionally, some of the water W enters the first end 16 of the first tubular member 12 and is held within the first tubular member 12 by the check valve 24. During the upward stroke of the well development tool 10, the washer 34 creates a suction within the well casing 42 below the washer 34 causing the underground water W to be pulled toward and into the well casing 42. This process, which is similar to the operation of a toilet plunger, is repeated through several iterations until a substantial portion of the water W that was originally located proximate the well casing 42 is trapped within the first tubular member 12. At this point water W that was originally located distant the well casing 42 has now percolated toward and into the well casing 42. This percolated water W is progressively free of the contaminants introduced by the boring of the hole and the insertion of the well casing 42 into the hole and continues until the water W is representative of the actual water conditions in the undisturbed area outside of the well casing 42. Although some time period may still need to elapse after well development before testing of the ground water W can occur, this time period is substantially shortened by using the well development tool 10. If the well development tool 10 is used in conjunction with an upper valve 32, the valve 32 is in a closed position during the well development process in order to help force the water W out of the screen during the downward stroke.

While the invention has been particularly shown and described with reference to an embodiment thereof, it will be appreciated by those skilled in the art that various changes in form and detail may be made without departing from the spirit and scope of the invention.

I claim:

1. A well development tool, in combination with a well casing, the well casing extending into the ground, the well development tool comprising:

a hollow first-tubular member having an outer surface, a first end, and a second end;

a check valve disposed within the first tubular member at the first end;

a washer encompassing the outer surface of the first tubular member proximate the first end;

a handle attached to the second end of the first tubular member;

an elbow attached to the second end of the first tubular member;

a second tubular member attached to the elbow; and such that the first tubular member is inserted into the well casing and reciprocated up and down within the well casing.

2. The well development tool as in claim 1 wherein the first tubular member is made from PVC.

3. The well development tool as in claim 1 wherein the washer is made from a resilient material.

4. The well development tool as in claim 1 wherein the washer is made from a material selected from the group consisting of rubber and neoprene.

5. The well development tool as in claim 1 wherein the handle has an upper valve.

6. The well development tool as in claim 1 wherein the inside of the well casing has a first diameter and the washer has a second diameter that is at least equal to the first diameter.

7. The well development tool as in claim 1 wherein the first tubular member is made from PVC.

8. The well development tool as in claim 1 wherein the washer is made from a resilient material.

9. The well development tool as in claim 1 wherein the washer is made from a material selected from the group consisting of rubber and neoprene.

10. A method for developing a well comprising the steps of:

boring a hole into the earth;

providing a well casing and disposing the well casing into the hole;

providing a hollow first tubular member having an outer surface, a first end, a second end having a handle thereon, the handle having an elbow attached to the second end of the first tubular member and a second tubular member attached to the elbow, and a washer encompassing the outer surface, the hollow tubular member allowing water to flow in only one direction therethrough; and inserting the first end of the first tubular member into the well casing and reciprocating the first tubular member up and down.

11. The method as in claim 10 wherein the first tubular member is made from PVC.

12. The method as in claim 10 wherein the washer is made from a resilient material.

13. The method as in claim 10 wherein the washer is made from a material selected from the group consisting of rubber and neoprene.

14. The method as in claim 10 wherein the handle has a valve.

15. The method as in claim 10 wherein the inside of the well casing has a first diameter and the washer has a second diameter that is at least equal to the first diameter.

16. A well development tool, in combination with a well casing, the well casing extending into the ground, the well development tool comprising:

a hollow first tubular member having an outer surface, a first end, and a second end;

a check valve disposed within the first tubular member at the first end;

a washer encompassing the outer surface of the first tubular member proximate the first end; and a handle attached to the second end of the first tubular member, the handle having an upper valve; and such that the first tubular member is inserted into the well casing and reciprocated up and down within the well casing.

17. The well development tool as in claim 16 wherein the first tubular member is made from PVC.

18. The well development tool as in claim 16 wherein the washer is made from a resilient material.

19. The well development tool as in claim 16 wherein the washer is made from a material selected from the group consisting of rubber and neoprene.

20. The well development tool as in claim 16 wherein the inside of the well casing has a first diameter and the washer has a second diameter that is at least equal to the first diameter.

21. The well development tool as in claim 16 wherein the first tubular member is made from PVC.

22. The well development tool as in claim 16 wherein the washer is made from a resilient material.

23. The well development tool as in claim 16 wherein the washer is made from a material selected from the group consisting of rubber and neoprene.

24. A method for developing a well comprising the steps of:

boring a hole into the earth;

providing a well casing and disposing the well casing into the hole;

providing a hollow first tubular member having an outer surface, a first end, a second end having a handle with a valve therein, and a washer encompassing the outer surface, the hollow tubular member allowing water to flow in only one direction therethrough; and inserting the first end of the first tubular member into the well casing and reciprocating the first tubular member up and down.

25. The method as in claim 24 wherein the first tubular member is made from PVC.

26. The method as in claim 24 wherein the washer is made from a resilient material.

27. The method as in claim 24 wherein the washer is made from a material selected from the group consisting of rubber and neoprene.

28. The method as in claim 24 wherein the second end of the first tubular member has a valve.

29. The method as in claim 24 wherein the inside of the well casing has a first diameter and the washer has a second diameter that is at least equal to the first diameter.

* * * * *